US008372212B2

(12) United States Patent
Sato et al.

(10) Patent No.: US 8,372,212 B2
(45) Date of Patent: Feb. 12, 2013

(54) SUPERCRITICAL DRYING METHOD AND APPARATUS FOR SEMICONDUCTOR SUBSTRATES

(75) Inventors: Yohei Sato, Yokohama (JP); Hisashi Okuchi, Yokohama (JP); Hiroshi Tomita, Yokohama (JP); Hidekazu Hayashi, Yokohama (JP); Yukiko Kitajima, Komatsu (JP); Takayuki Toshima, Koshi (JP); Mitsuaki Iwashita, Nirasaki (JP); Kazuyuki Mitsuoka, Nirasaki (JP); Gen You, Nirasaki (JP); Hiroki Ohno, Nirasaki (JP); Takehiko Orii, Nirasaki (JP)

(73) Assignees: Kabushiki Kaisha Toshiba, Tokyo (JP); Tokyo Electron Limited, Tokyo (JP)

( * ) Notice: Subject to any disclaimer, the term of this patent is extended or adjusted under 35 U.S.C. 154(b) by 0 days.

(21) Appl. No.: 13/369,970

(22) Filed: Feb. 9, 2012

(65) Prior Publication Data

US 2012/0247516 A1 Oct. 4, 2012

(30) Foreign Application Priority Data

Apr. 4, 2011 (JP) ..... 2011-082753

(51) Int. Cl.
*B08B 3/04* (2006.01)

(52) U.S. Cl. ..... 134/26; 451/36; 451/51; 451/61; 34/92; 34/337; 34/339; 34/340; 205/640; 134/21; 134/30; 134/31; 134/34; 134/36; 134/37; 134/42; 134/902

(58) Field of Classification Search ..... 134/21, 134/26, 30, 31, 34, 36, 37, 42, 902; 34/92, 34/337, 339, 340; 451/36, 51, 61; 205/640
See application file for complete search history.

(56) References Cited

U.S. PATENT DOCUMENTS

2011/0289793 A1* 12/2011 Hayashi et al. ..... 34/357
2011/0314689 A1 12/2011 Okuchi et al.
2012/0118332 A1* 5/2012 Sato et al. ..... 134/30
2012/0240426 A1* 9/2012 Hayashi et al. ..... 34/351

FOREIGN PATENT DOCUMENTS

JP 2006-332215 12/2006

OTHER PUBLICATIONS

Sato, Y. et al., "Supercritical Drying Method for Semiconductor Substrate," U.S. Appl. No. 13/052,232, filed Mar. 21, 2011.
Hayashi, H. et al., "Supercritical Drying Device and Method," U.S. Appl. No. 13/160,350, filed Jun. 14, 2011.

* cited by examiner

*Primary Examiner* — Bibi Carrillo
(74) *Attorney, Agent, or Firm* — Finnegan, Henderson, Farabow, Garrett & Dunner, L.L.P.

(57) ABSTRACT

According to one embodiment, a supercritical drying method comprises cleaning a semiconductor substrate with a chemical solution, rinsing the semiconductor substrate with pure water after the cleaning, changing a liquid covering a surface of the semiconductor substrate from the pure water to alcohol by supplying the alcohol to the surface after the rinsing, guiding the semiconductor substrate having the surface wetted with the alcohol into a chamber, discharging oxygen from the chamber by supplying an inert gas into the chamber, putting the alcohol into a supercritical state by increasing temperature in the chamber to a critical temperature of the alcohol or higher after the discharge of the oxygen, and discharging the alcohol from the chamber by lowering pressure in the chamber and changing the alcohol from the supercritical state to a gaseous state. The chamber contains SUS. An inner wall face of the chamber is subjected to electrolytic polishing.

5 Claims, 5 Drawing Sheets

SUPERCRITICAL DRYING METHOD AND APPARATUS FOR SEMICONDUCTOR SUBSTRATES

CROSS REFERENCE TO RELATED APPLICATION

This application is based upon and claims benefit of priority from the Japanese Patent Application No. 2011-82753, filed on Apr. 4, 2011, the entire contents of which are incorporated herein by reference.

FIELD

Embodiments described herein relate generally to a supercritical drying method for a semiconductor substrate and a supercritical drying apparatus for a semiconductor substrate.

BACKGROUND

A semiconductor device manufacturing process includes various steps such as a lithography step, a dry etching step, and an ion implantation step. After each step is finished, the following processes are carried out before the operation moves on to the next step: a cleaning process to remove impurities and residues remaining on the wafer surface and clean the wafer surface; a rinsing process to remove the chemical solution residues after the cleaning; and a drying process.

For example, in the wafer cleaning process after the etching step, a chemical solution for the cleaning process is supplied to the wafer surface. Pure water is then supplied, and the rinsing process is performed. After the rinsing process, the pure water remaining on the wafer surface is removed, and the drying process is performed to dry the wafer.

As the methods of performing the drying process, the following methods have been known: a rotary drying method by which pure water remaining on a wafer is discharged by utilizing the centrifugal force generated by rotations; and an IPA drying method by which pure water on a wafer is replaced with isopropyl alcohol (IPA), and the IPA is evaporated to dry the wafer. By those conventional drying methods, however, fine patterns formed on a wafer are brought into contact with one another at the time of drying due to the surface tension of the liquid remaining on the wafer, and as a result, a blocked state might be caused.

To solve such a problem, supercritical drying to reduce the surface tension to zero has been suggested. In the supercritical drying, after the wafer cleaning process, the liquid on the wafer is replaced with a solvent such as IPA to be replaced with a supercritical drying solvent at last. The wafer having its surface wetted with IPA is guided into a supercritical chamber. After that, carbon dioxide in a supercritical state (a supercritical $CO_2$ fluid) is supplied into the chamber, and the IPA is replaced with the supercritical $CO_2$ fluid. The IPA on the wafer is gradually dissolved in the supercritical $CO_2$ fluid, and is discharged together with the supercritical $CO_2$ fluid from the wafer. After all the IPA is discharged, the pressure in the chamber is lowered, and the supercritical $CO_2$ fluid is phase-changed to gaseous $CO_2$. The wafer drying is then ended.

By another known method, a supercritical $CO_2$ fluid is not necessarily used as the drying solvent, and alcohol such as IPA serving as a substitution liquid for the rinse pure water after the cleaning with the chemical solution is put into a supercritical state. The alcohol is then evaporated and discharged, to perform drying. This technique is readily used, because alcohol is advantageously liquid at ordinary temperature and has a lower critical pressure than that of $CO_2$. At high pressure and temperature, however, the alcohol has a decomposition reaction, and the etchant generated through the decomposition reaction performs etching on the metal material existing on the semiconductor substrate. As a result, the electrical characteristics of the semiconductor device are degraded.

DETAILED DESCRIPTION

According to one embodiment, a supercritical drying method for a semiconductor substrate comprises cleaning the semiconductor substrate with a chemical solution, rinsing the semiconductor substrate with pure water after the cleaning, changing a liquid covering a surface of the semiconductor substrate from the pure water to alcohol by supplying the alcohol to the surface of the semiconductor substrate after the rinsing, guiding the semiconductor substrate having the surface wetted with the alcohol into a chamber, discharging oxygen from the chamber by supplying an inert gas into the chamber, putting the alcohol into a supercritical state by increasing temperature in the chamber to a critical temperature of the alcohol or higher after the discharge of the oxygen, and discharging the alcohol from the chamber by lowering pressure in the chamber and changing the alcohol from the supercritical state to a gaseous state. The chamber contains SUS. An inner wall face of the chamber is subjected to electrolytic polishing.

Embodiments will now be explained with reference to the accompanying drawings.

(First Embodiment)

Figure 1:
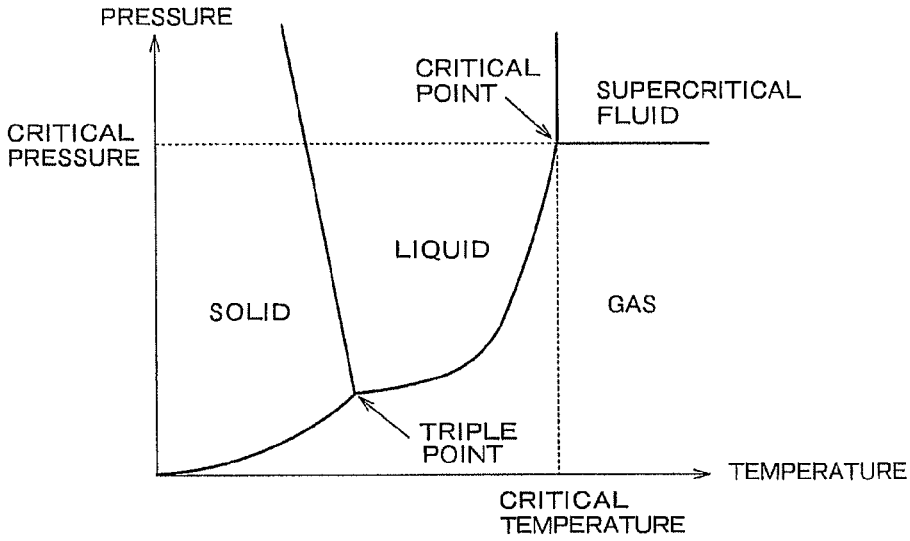
FIG. 1 is a state diagram showing the relationship among the pressure, the temperature, and the phase state of a substance.

First, supercritical drying is described. FIG. 1 is a state diagram showing the relationship among the pressure, the temperature, and the phase state of a substance. A supercritical fluid used in supercritical drying is functionally in the following three states called the "three states of matter": the gaseous phase (gas), the liquid phase (liquid), and the solid phase (solid).

As shown in FIG. 1, the above three phases are divided by the vapor pressure curve (the gaseous equilibrium line) indicating the boundary between the gaseous phase and the liquid phase, the sublimation curve indicating the boundary between the gaseous phase and the solid phase, and the dissolution curve indicating the boundary between the solid phase and the liquid phase. The point where those three phases overlap one another is the triple point. The vapor pressure curve extending from the triple point toward the high-temperature side reaches the critical point, which is the limit of coexistence of the gaseous phase and the liquid phase. At this critical point, the gas density and the liquid density are equal to each other, and the phase boundary in the vapor-liquid coexistence disappears.

Where the temperature and the pressure are both higher than the critical point, the distinction between the gaseous state and the liquid state is lost, and the substance turns into a supercritical fluid. A supercritical fluid is a fluid compressed at a high density and at a temperature equal to or higher than the critical temperature. A supercritical fluid is similar to a gas in that the diffusibility of the solvent molecules is dominant. Also, a supercritical fluid is similar to a liquid in that the influence of the molecule cohesion cannot be ignored. Accordingly, a supercritical fluid characteristically dissolves various kinds of substances.

A supercritical fluid also has much higher infiltration properties than those of a liquid, and easily infiltrates a microstructure.

A supercritical fluid can dry a microstructure without breaking the microstructure by transiting from a supercritical state directly to a gaseous phase, so that the boundary between the gaseous phase and the liquid phase does not appear, or a capillary force (surface tension) is generated. Supercritical drying is to dry a substrate by using the supercritical state of such a supercritical fluid.

Figure 2:
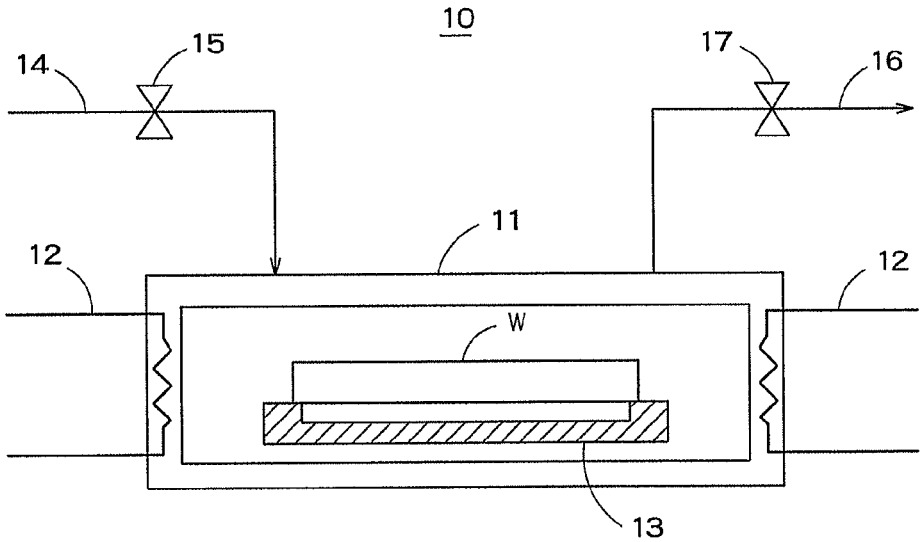
FIG. 2 is a schematic view showing the structure of a supercritical drying apparatus according to a first embodiment.

Referring now to FIG. 2, a supercritical drying apparatus that performs supercritical drying on a semiconductor substrate is described. As shown in FIG. 2, a supercritical drying apparatus 10 includes a chamber 11 containing a heater 12. The chamber 11 is a high-pressure container in which a predetermined pressure resistance is maintained, and the chamber 11 is made of steel use stainless (SUS). The heater 12 can adjust the temperature in the chamber 11. In FIG. 2, the heater 12 is contained in the chamber 11, but the heater 12 may be provided at an outer circumferential portion of the chamber 11.

A ring-like flat stage 13 that holds a semiconductor substrate W to be subjected to supercritical drying is provided in the chamber 11.

A pipe 14 is connected to the chamber 11, so that an inert gas such as a nitrogen gas, a carbon dioxide gas, or a rare gas (such as an argon gas) can be supplied into the chamber 11. A pipe 16 is connected to the chamber 11, so that the gas or supercritical fluid in the chamber 11 can be discharged to the outside via the pipe 16.

The pipe 14 and the pipe 16 are made of the same material (SUS) as that of the chamber 11. A valve 15 and a valve 17 are provided on the pipe 14 and the pipe 16, respectively, and the valve 15 and the valve 17 are closed so that the chamber 11 can be hermetically closed.

Figure 3:
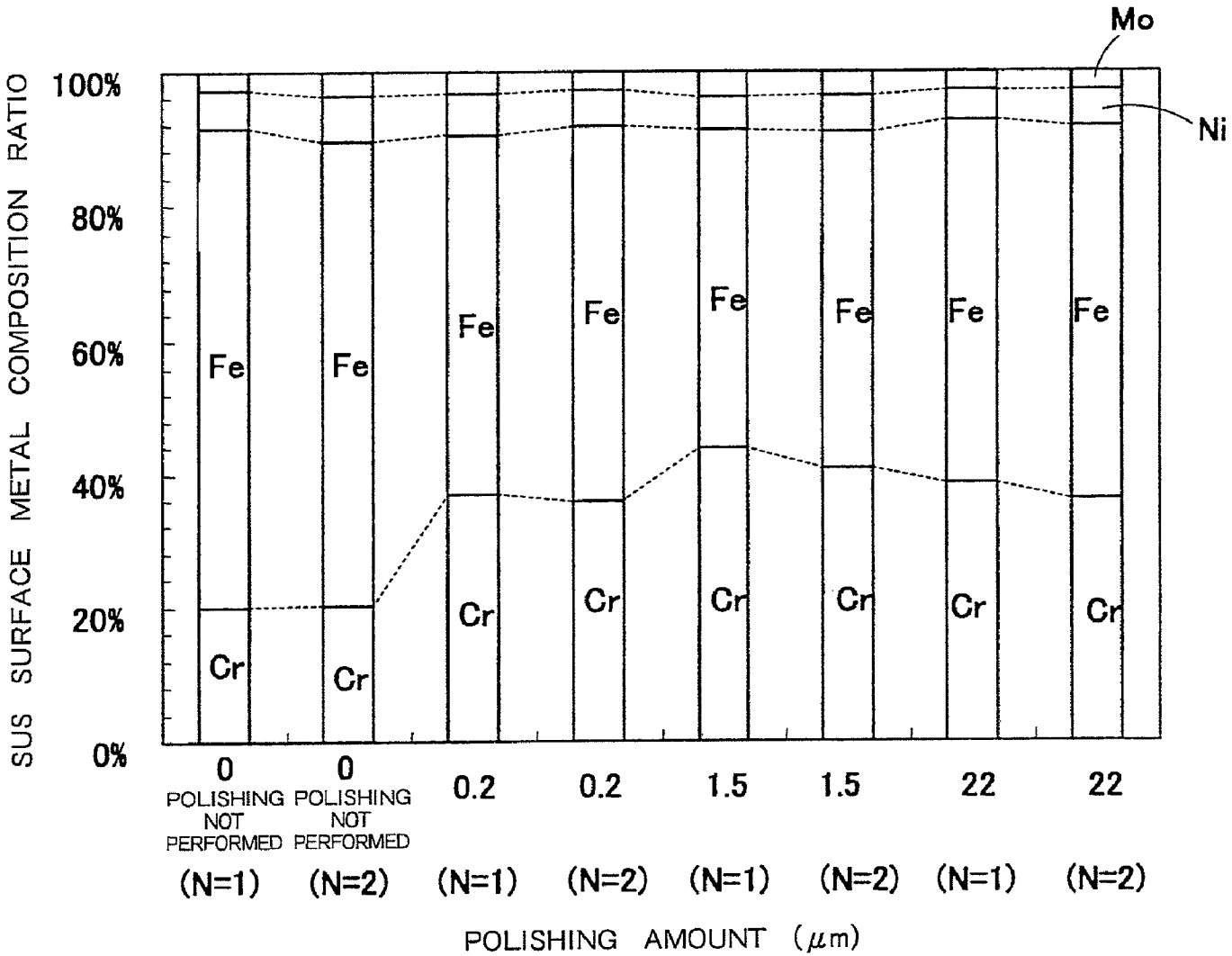
FIG. 3 is a graph showing variations of the metal composition in a SUS surface, the variations depending on an electrolytic polishing process.

Electrolytic polishing is performed on the surfaces (the inner wall faces) of the chamber 11. FIG. 3 shows the variation of the metal composition of the surface portions of the chamber 11 due to the electrolytic polishing. The metal composition was analyzed by XPS (X-ray photoelectron spectroscopy). Electrolytic polishing was performed on two chambers. One of the chambers is represented by N=1, and the other chamber is represented by N=2. The analysis results are shown in FIG. 3.

As can be seen from FIG. 3, the chromium (Cr) density in the surface portions of the chamber 11 was increased by the electrolytic polishing. This is because the iron (Fe) in the surfaces of the SUS was selectively dissolved in the electrolytic solution. Regardless of the polishing amount, the Cr density in the surface portions of the chamber 11 was made 35% or higher by the electrolytic polishing. Here, the surface portions of the chamber 11 are the regions at a depth of approximately 5 nm from the respective surfaces.

The surface portions of the chamber 11 are made of an oxide film containing $Fe_2O_3$ or $Cr_2O_3$. $Cr_2O_3$ is more chemically stable than $Fe_2O_3$. Therefore, by increasing the chromium (Cr) density by the electrolytic polishing, the corrosion resistance of the surface of the chamber 11 can be increased.

Electrolytic polishing is also performed at least on a portion of the inner wall face of the pipe 14 located between the chamber 11 and the valve 15, and at least on a portion of the inner wall face of the pipe 16 located between the chamber 11 and the valve 17. That is, electrolytic polishing is performed on the portions with which the supercritical fluid is brought into contact at the time of the later described supercritical drying.

Figure 4:
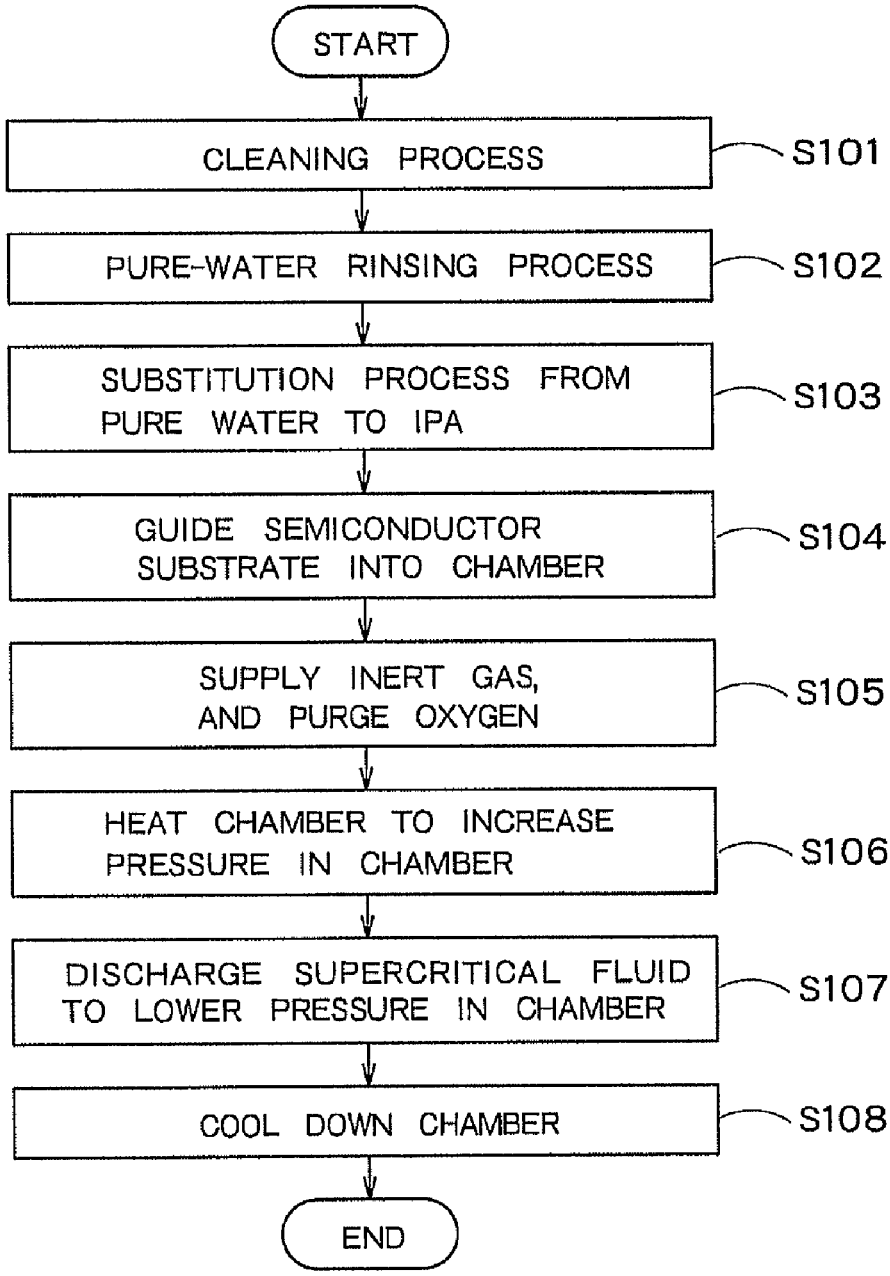
FIG. 4 is a flowchart for explaining a supercritical drying method according to the first embodiment.

Referring now to the flowchart shown in FIG. 4, a method of cleaning and drying a semiconductor substrate according to this embodiment is described.

(Step S101) A semiconductor substrate to be processed is guided into a cleaning chamber (not shown). A chemical solution is supplied to the surface of the semiconductor substrate, and a cleaning process is performed. As the chemical solution, sulfuric acid, hydrofluoric acid, hydrochloric acid, hydrogen peroxide, or the like can be used.

Here, the cleaning process includes a process to remove a resist from the semiconductor substrate, a process to remove particles and metallic impurities, and a process to remove films formed on the substrate by etching. A fine pattern including a metal film such as a tungsten film is formed on the semiconductor substrate. The fine pattern may be formed prior to the cleaning process, or may be formed through the cleaning process.

(Step S102) After the cleaning process in step S101, pure water is supplied onto the surface of the semiconductor substrate, and a pure-water rinsing process is performed by washing away the remained chemical solution from the surface of the semiconductor substrate with the pure water.

(Step S103) After the pure-water rinsing process in step S102, the semiconductor substrate having the surface wetted with the pure water is immersed into a water-soluble organic solvent, and a liquid substitution process is performed to change the liquid on the semiconductor substrate surface from the pure water to the water-soluble organic solvent. The water-soluble organic solvent is alcohol, and isopropyl alcohol (IPA) is used here.

(Step S104) After the liquid substitution process in step S103, the semiconductor substrate is taken out of the cleaning chamber in such a manner that the surface remains wetted with the IPA and is not dried naturally. The semiconductor substrate is then guided into the chamber 11 illustrated in FIG. 2, and is secured onto the stage 13.

(Step S105) The lid of the chamber 11 is closed, and the valve 15 and the valve 17 are opened. An inert gas such as a nitrogen gas is then supplied into the chamber 11 via the pipe 14, and oxygen is purged from the chamber 11 via the pipe 16.

The period of time to supply the inert gas into the chamber 11 is determined by the volume of the chamber 11 and the amount of IPA in the chamber 11. Alternatively, the oxygen density in the exhaust air from a glove box (not shown) provided on the chamber 11 may be monitored, and the inert gas may be supplied until the oxygen density becomes a predetermined value (100 ppm, for example) or lower.

(Step S106) After oxygen is purged from the chamber 11, the valve 15 and the valve 17 are closed to put the inside of the chamber 11 into a hermetically-closed state. The heater 12 is then used to heat the IPA covering the surface of the semiconductor substrate in the hermetically-closed chamber 11. As the IPA that is heated and is evaporated increases in volume, the pressure in the chamber 11 that is hermetically closed and is constant in volume increases as indicated by the IPA vapor pressure curve shown in FIG. 5.

The actual pressure in the chamber 11 is the total sum of the partial pressures of all the gas molecules existing in the chamber 11. In this embodiment, however, the partial pressure of the gaseous IPA is described as the pressure in the chamber 11.

Figure 5:
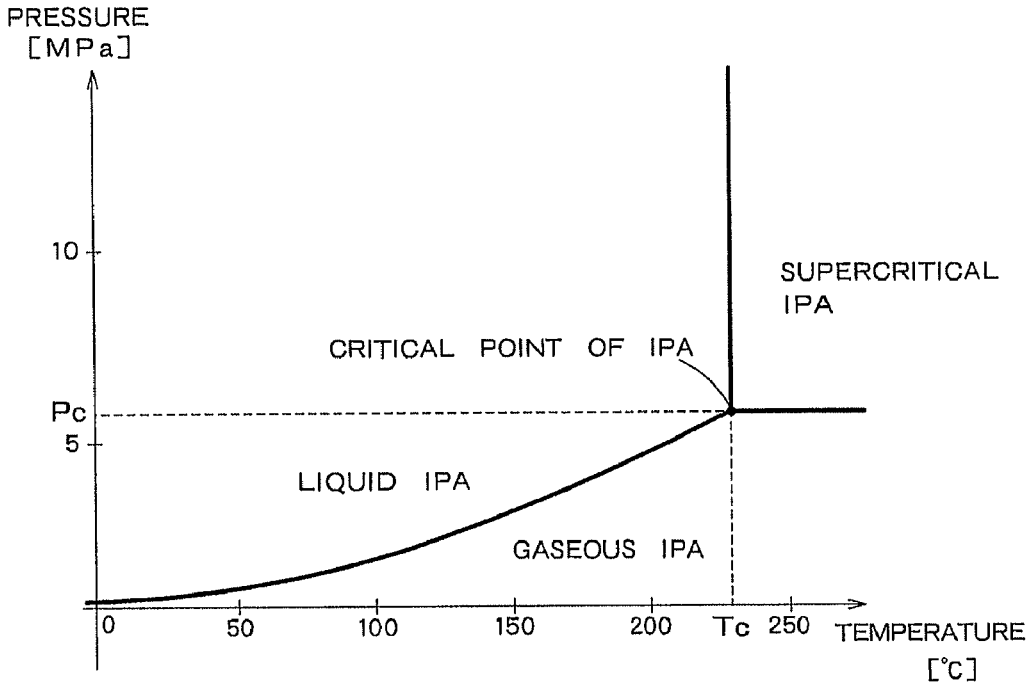
FIG. 5 is a graph showing the vapor pressure curve of IPA.

As shown in FIG. 5, where the pressure in the chamber 11 has reached the critical pressure Pc (≈5.4 MPa), the IPA is heated to the critical temperature Tc (≈235.6° C.) or higher, and the gaseous IPA and the liquid IPA in the chamber 11 are then put into a supercritical state. Accordingly, the chamber 11 is filled with supercritical IPA (IPA in the supercritical state), and the surface of the semiconductor substrate is covered with the supercritical IPA.

Before the IPA is put into the supercritical state, the liquid IPA covering the surface of the semiconductor substrate is not evaporated. That is, the semiconductor substrate remains wetted with the liquid IPA, and the gaseous IPA and the liquid IPA are made to coexist in the chamber 11.

The temperature Tc, the pressure Pc, and the volume of the chamber 11 are assigned to respective variables in the gas state equation (PV=nRT, where P represents pressure, V represents volume, n represents molar number, R represents gas constant, and T represents temperature), to determine the amount nc (mol) of the IPA in the gaseous state in the chamber 11 when the IPA reaches the supercritical state.

Before the inert gas supply is started in step S105, nc (mol) or more of liquid IPA needs to exist in the chamber 11. If the amount of IPA existing on the semiconductor substrate to be guided into the chamber 11 is smaller than nc (mol), liquid IPA is supplied into the chamber 11 from a chemical solution supply unit (not shown), so that nc (mol) or more of liquid IPA exists in the chamber 11.

Where oxygen exists in the chamber 11, the metal film on the semiconductor substrate is oxidized by the oxygen. As the IPA in the chamber 11 has a decomposition reaction, with the catalyst being the iron (Fe) of the SUS forming the chamber 11, the etchant generated by the decomposition reaction performs etching on the oxidized metal film on the semiconductor substrate.

In this embodiment, however, an inert gas is supplied in step S105, so that the oxygen density in the chamber 11 is made extremely low. Accordingly, in drying operations, oxidation of the metal film on the semiconductor substrate can be prevented.

The inner walls of the chamber 11, the pipe 14, and the pipe 16 with which the supercritical IPA is in contact are surfaces that are made to have high Cr densities and be chemically stable by virtue of the electrolytic polishing. Accordingly, decomposition reactions of the IPA using the surfaces of the chamber 11 as the catalyst can be prevented.

As described above, by preventing oxidation of the metal film on the semiconductor substrate and decomposition reactions of the IPA, etching of the metal film on the semiconductor substrate can be prevented.

(Step S107) After the heating in step S106, the valve 17 is opened to discharge the supercritical IPA from the chamber 11 and lower the pressure in the chamber 11. When the pressure in the chamber 11 becomes equal to or lower than the critical pressure Pc of IPA, the phase of the IPA changes from the supercritical fluid to a gas.

(Step S108) After the pressure in the chamber 11 is lowered to atmospheric pressure, the chamber 11 is cooled down, and the semiconductor substrate is taken out of the chamber 11.

After the pressure in the chamber 11 is lowered to atmospheric pressure, the semiconductor substrate may be transported into a cooling chamber (not shown) while remaining hot, and may be then cooled down. In that case, the chamber 11 can be always maintained in a certain high-temperature state. Accordingly, the period of time required for the semiconductor substrate drying operation can be shortened.

As described above, in this embodiment, when a supercritical drying operation is performed so that alcohol such as IPA serving as a replacement solution for rinse pure water is put into a supercritical state, etching of the metal material existing on the semiconductor substrate can be prevented, and accordingly, degradation of the electrical characteristics of the semiconductor device can be prevented.

Figure 6:
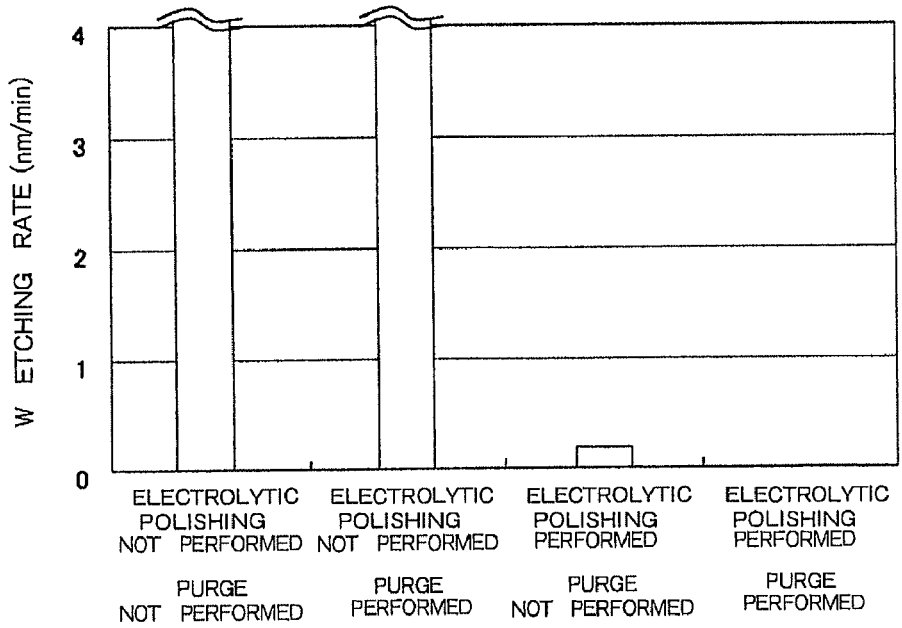
FIG. 6 is a graph showing the relationship among the electrolytic polishing process, an inert gas purge, and a tungsten etching rate.

FIG. 6 shows the results of an experiment carried out to check the differences in etching rate among metal films in supercritical drying operations in cases where the electrolytic polishing was performed or not performed on the chamber made of SUS, and where the oxygen purge from the chamber (equivalent to step S105 of FIG. 4) was performed or not performed by supply of the inert gas.

In this experiment, a tungsten film of 100 nm in thickness was formed on each semiconductor substrate, and the temperature in each chamber was increased to 250° C. Each semiconductor substrate was then left in supercritical IPA for six hours. The polishing amount of each chamber in the electrolytic polishing process was 1.5 μm. Nitrogen was used as the inert gas.

In the cases where the electrolytic polishing was not performed on the chamber, all the tungsten film on the semiconductor substrate was removed by the supercritical drying operation, regardless of whether the oxygen purge was performed. The tungsten etching rate became too high to be measured.

In the case where the electrolytic polishing was performed on the chamber but the oxygen purge (step S105 of FIG. 4) was not performed, the tungsten etching rate was approximately 0.17 nm/minute. This result indicates that the tungsten etching rate was greatly reduced, compared with the cases where the electrolytic polishing was not performed on the chamber. This is supposedly because the chamber surfaces were put into a chemically-stabilized state with high Cr densities by virtue of the electrolytic polishing, and decomposition reactions of the IPA using the chamber surfaces as the catalyst were prevented, as described above.

In the case where the electrolytic polishing was performed on the chamber and the oxygen purge (step S105 of FIG. 4) was further performed, etching was hardly performed on the tungsten film on the semiconductor substrate, and the etching rate was almost 0 nm/minute. This is supposedly because the chamber surfaces were put into a chemically-stabilized state with high Cr densities by virtue of the electrolytic polishing, and decomposition reactions of the IPA using the chamber surfaces as the catalyst were prevented, as described above. In addition to that, the etching rate was almost zero supposedly because the oxygen density in the chamber was made extremely low so as to prevent oxidation of the tungsten film during the drying operation.

As can be seen from the experiment results shown in FIG. 6, etching of the metal material existing on the semiconductor substrate during the supercritical drying operation can be prevented by using a chamber subjected to the electrolytic polishing and purging oxygen from the chamber with the use of an inert gas prior to the heating of IPA.

As described above, by the supercritical drying method according to this embodiment, etching of the metal material existing on the semiconductor substrate can be restrained, and degradation of the electrical characteristics of the semiconductor device can be prevented.

(Second Embodiment)

Figure 7A:
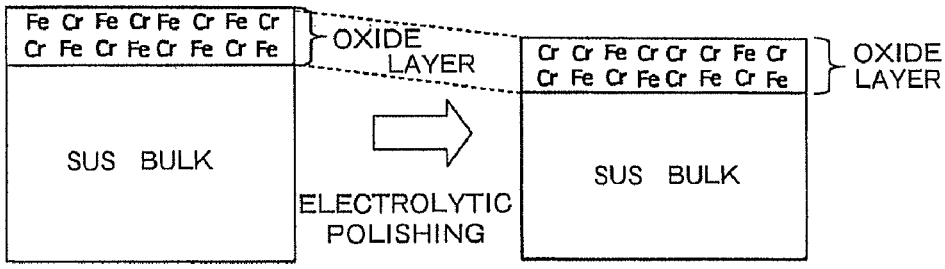
FIG. 7A is a diagram showing a variation of the oxide film in the SUS surface
Figure 7B:
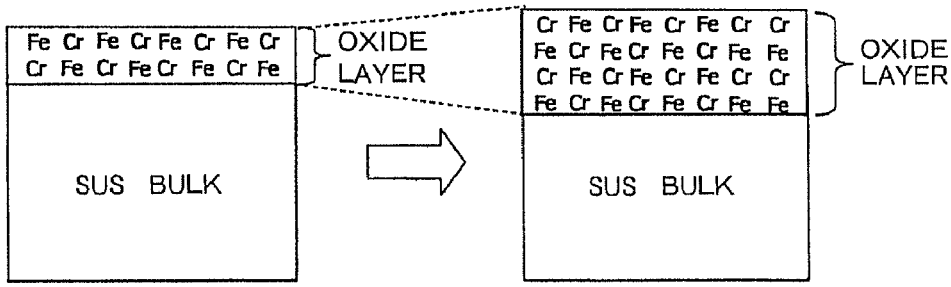
FIG. 7B is a diagram showing a variation of the oxide film in the SUS surface.

In the above described first embodiment, the Cr density in the oxide film at the surface portions of the SUS forming the chamber 11 is increased by the electrolytic polishing, so that the surfaces of the chamber 11 are put into a chemically-stabilized state, as shown in FIG. 7A. However, the oxide film at the surface portions of the chamber 11 may be made thicker, so that the surfaces of the chamber 11 are put into a chemically-stabilized state, as shown in FIG. 7B.

IPA is supplied into the chamber 11, and the IPA is put into a supercritical state. The chamber 11 is then exposed to the supercritical IPA for a predetermined period of time. In this manner, the oxide film at the surface portions of the chamber 11 can be made thicker. For example, the inside of the chamber 11 is heated to 250° C., and the inner walls of the chamber 11 are exposed to the supercritical IPA for approximately six hours. In this manner, the film thickness of the oxide film at the surface portions of the chamber 11 can be increased from approximately 3 nm to approximately 7 nm. At this point, the film thickness of the oxide film is also increased from approximately 3 nm to approximately 7 nm at least at the surface portion of the inner wall of the pipe 14 located between the chamber 11 and the valve 15, and at least at the surface portion of the inner wall of the pipe 16 located between the chamber 11 and the valve 17.

Figure 8:
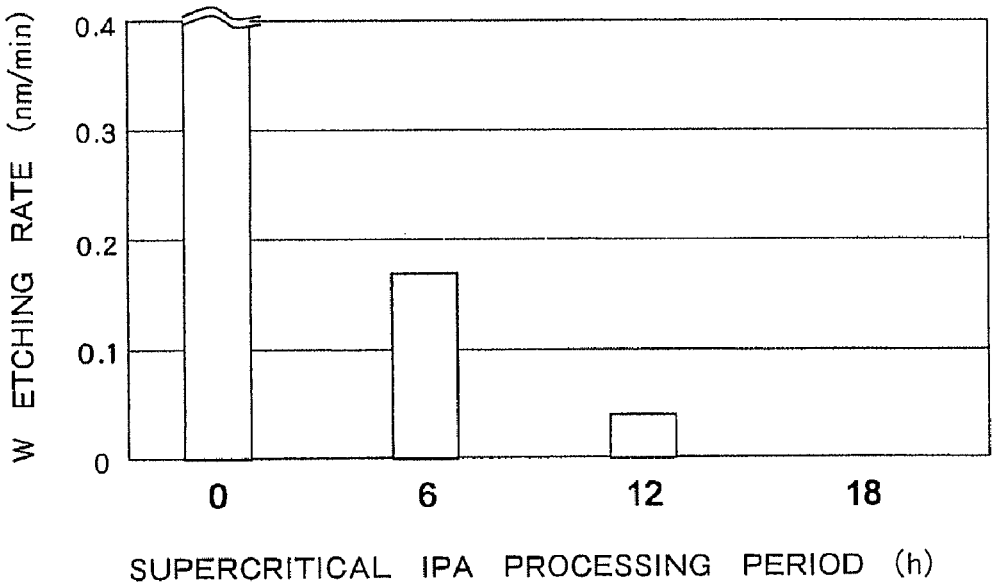
FIG. 8 is a graph showing the relationship between the period of supercritical IPA processing performed on the chamber and the tungsten etching rate.

FIG. 8 shows the results of an experiment carried out to check the etching rates of the metal films on semiconductor substrates in respective supercritical drying operations performed in a case where a chamber not exposed to supercritical IPA (a chamber not having the thickness of the oxide film increased) was used, a case where a chamber exposed to supercritical IPA for six hours was used, a case where a chamber exposed to supercritical IPA for 12 hours was used, and a case where a chamber exposed to supercritical IPA for 18 hours was used. Each of the supercritical drying operations performed here was the same as that illustrated in FIG. 4.

In this experiment, a tungsten film of 100 nm in thickness was formed on each semiconductor substrate, and the temperature in each chamber was increased to 250° C. Each semiconductor substrate was then left in supercritical IPA for six hours. Nitrogen was used as the inert gas.

In the case where a chamber not exposed to supercritical IPA (a chamber not having the thickness of the oxide film increased) was used, all the tungsten film on the semiconductor substrate was removed by the supercritical drying operation. The tungsten etching rate became too high to be measured.

In the case where a chamber exposed to supercritical IPA for six hours was used, the tungsten etching rate was approximately 0.17 nm/minute. This result indicates that the tungsten etching rate can be greatly lowered, compared with the case where a chamber not exposed to supercritical IPA was used. This is supposedly because the chamber surfaces were put into a chemically-stabilized state as the film thickness of the oxide film at the surface portions was increased to approximately 7 nm, and decomposition reactions of IPA using the chamber surfaces as the catalyst were prevented.

In the case where a chamber exposed to supercritical IPA for 12 hours was used, the tungsten etching rate became even lower. This is supposedly because the oxide film in the chamber surfaces became even thicker, and the chamber surfaces were put into a more chemically-stabilized state. In the case where a chamber exposed to supercritical IPA for 18 hours was used, etching was hardly performed on the tungsten film on the semiconductor substrate, and the etching rate was almost 0 nm/minute.

As described above, etching of the metal material existing on a semiconductor substrate during a supercritical drying operation can be prevented by using a chamber having the oxide film made thicker at the surface portions and purging oxygen from the chamber with the use of an inert gas prior to the heating of IPA.

In the above described second embodiment, the chamber 11 is exposed to supercritical IPA, or the film thickness of the oxide film at the surface portions is increased by a "dummy run" of a supercritical drying operation. However, some other technique may be used. For example, the oxide film at the surface portions of the SUS forming the chamber 11 can be made thicker by performing oxidation using an ozone gas. Alternatively, alcohol other than IPA may be put into a supercritical state, and the chamber 11 may be exposed to the supercritical alcohol, to increase the thickness of the oxide film at the surface portions.

Also, in the above described second embodiment, the film thickness of the oxide film at the surface portions of the inner walls of the chamber 11 is increased to approximately 7 nm. However, the film thickness of the oxide film may be made equal to or greater than 7 nm.

In the above described embodiments, the metal film formed on each semiconductor substrate is a tungsten film. However, the same effects as those described above can be achieved in cases where a metal film made of molybdenum or the like having electrochemical characteristics similar to those of tungsten.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A supercritical drying method for a semiconductor substrate, comprising:

cleaning the semiconductor substrate with a chemical solution;

rinsing the semiconductor substrate with pure water after the cleaning;

changing a liquid covering a surface of the semiconductor substrate from the pure water to alcohol by supplying the alcohol to the surface of the semiconductor substrate after the rinsing;

guiding the semiconductor substrate having the surface wetted with the alcohol, into a chamber containing steel use stainless (SUS), an inner wall face of the chamber being subjected to electrolytic polishing;

discharging oxygen from the chamber by supplying an inert gas into the chamber;

putting the alcohol into a supercritical state by increasing a temperature in the chamber to a critical temperature of the alcohol or higher after the discharge of the oxygen; and discharging the alcohol from the chamber by lowering a pressure in the chamber and changing the alcohol from the supercritical state to a gaseous state.

2. The method according to claim 1, wherein, prior to the supply of the inert gas, the alcohol with a fluid volume based on the a critical temperature and critical pressure of the alcohol, and on a volume of the chamber is supplied into the chamber.

3. The method according to claim 1, wherein a metal film containing one of tungsten and molybdenum is formed on the semiconductor substrate.

4. The method according to claim 1, wherein an oxygen density in an exhaust air from a glove box provided on the chamber is monitored, and the supply of the inert gas is continued until the oxygen density becomes a predetermined value or lower.

5. The method according to claim 1, wherein the inert gas is one of a nitrogen gas, a carbon dioxide gas, or a rare gas.

* * * * *